United States Patent [19]

Nakanishi

[11] Patent Number: 4,763,633

[45] Date of Patent: Aug. 16, 1988

[54] FUEL SUPPLY FOR A SMALL BOAT

[75] Inventor: Ichiro Nakanishi, Kakogawa, Japan

[73] Assignee: Kawasaki Jukogyo Kabushiki Kaisha, Chuo, Japan

[21] Appl. No.: 872,207

[22] Filed: Jun. 9, 1986

[30] Foreign Application Priority Data

Jun. 19, 1985 [JP] Japan ..... 60-92740[U]

[51] Int. Cl.[4] ..... F02M 39/00

[52] U.S. Cl. ..... 123/514; 123/198 D; 123/509

[58] Field of Search ..... 123/198 D, 514, 510, 123/509; 137/576, 579, 572

[56] References Cited

U.S. PATENT DOCUMENTS

| | | | |
|---|---|---|---|
| 4,279,232 | 7/1981 | Schuster | 123/514 |
| 4,296,723 | 10/1981 | Aldrich | 123/514 |
| 4,397,333 | 8/1983 | Liba | 123/514 |
| 4,503,885 | 3/1985 | Hall | 123/514 |
| 4,546,750 | 10/1985 | Brunell | 123/509 |

FOREIGN PATENT DOCUMENTS

| | | | |
|---|---|---|---|
| 2430636 | 2/1975 | Fed. Rep. of Germany | 123/509 |
| 2460101 | 6/1976 | Fed. Rep. of Germany | 123/514 |
| 353559 | 10/1937 | Italy | 123/198 D |
| 0119960 | 7/1983 | Japan | 123/514 |
| 1431393 | 4/1976 | United Kingdom | 123/514 |

*Primary Examiner*—Carl Stuart Miller

*Attorney, Agent, or Firm*—Marshall, O'Toole, Gerstein, Murray & Bicknell

[57] ABSTRACT

This disclosure relates to a small craft including a hull, an engine and a fuel tank in the hull, and a fuel supply system for carrying fuel from the tank to the engine. The supply system includes a suction pipe having an inlet opening within the tank. A fuel retention device is connected to the pipe around the inlet opening and it retains fuel at the inlet opening to prevent air from entering the opening when the opening is above the fuel level for a short time.

8 Claims, 3 Drawing Sheets

34
38

34
52
38

34
50

36
34
40
40
39
38
41
41
5
5

FUEL SUPPLY FOR A SMALL BOAT

FIELD AND BACKGROUND OF THE INVENTION

This invention relates to small watercraft of the type used primarily for leisure recreational activities and more particularly to a fuel supply system for an engine of such a craft.

Small craft of this character have become very popular in recent years. They are normally powered by a small gasoline engine including a carbureter of the "floatless" type which is used because it is unlikely to be influenced by severe changes in the attitude of the hull. It is normal in the operation of such a craft for this attitude to change quickly and drastically as the craft moves quickly over waves and as the operator changes the speed and direction of the craft.

It has been found that such movements of the craft causes the fuel level in the fuel tank or reservoir to flucuate. At times the fuel suction tube in the tank may be exposed to the air above the fuel level, causing fuel to be sucked into the fuel suction tube. When the air reaches the carbureter of the engine, it causes the engine to sputter or pulsate, rather than run smoothly.

It is a general object of the invention to provide an improved fuel supply for a small craft, which prevents air from being sucked into the fuel suction pipe when the hull changes its attitude greatly.

SUMMARY OF THE INVENTION

A fuel supply system according to the invention includes a fuel tank and a pump for pumping fuel from said tank to an engine carbureter through a suction pipe, the pipe having an inlet opening in said tank. Fuel retainer means is mounted on the inlet opening for retaining fuel therein when the inlet is out of the fuel and in the air in said tank for a short time.

BRIEF DESCRIPTION OF THE DRAWINGS

Preferred embodiments of this invention are described as follows with reference to the accompanying drawings, wherein.

DETAILED DESCRIPTION

Figure 1:
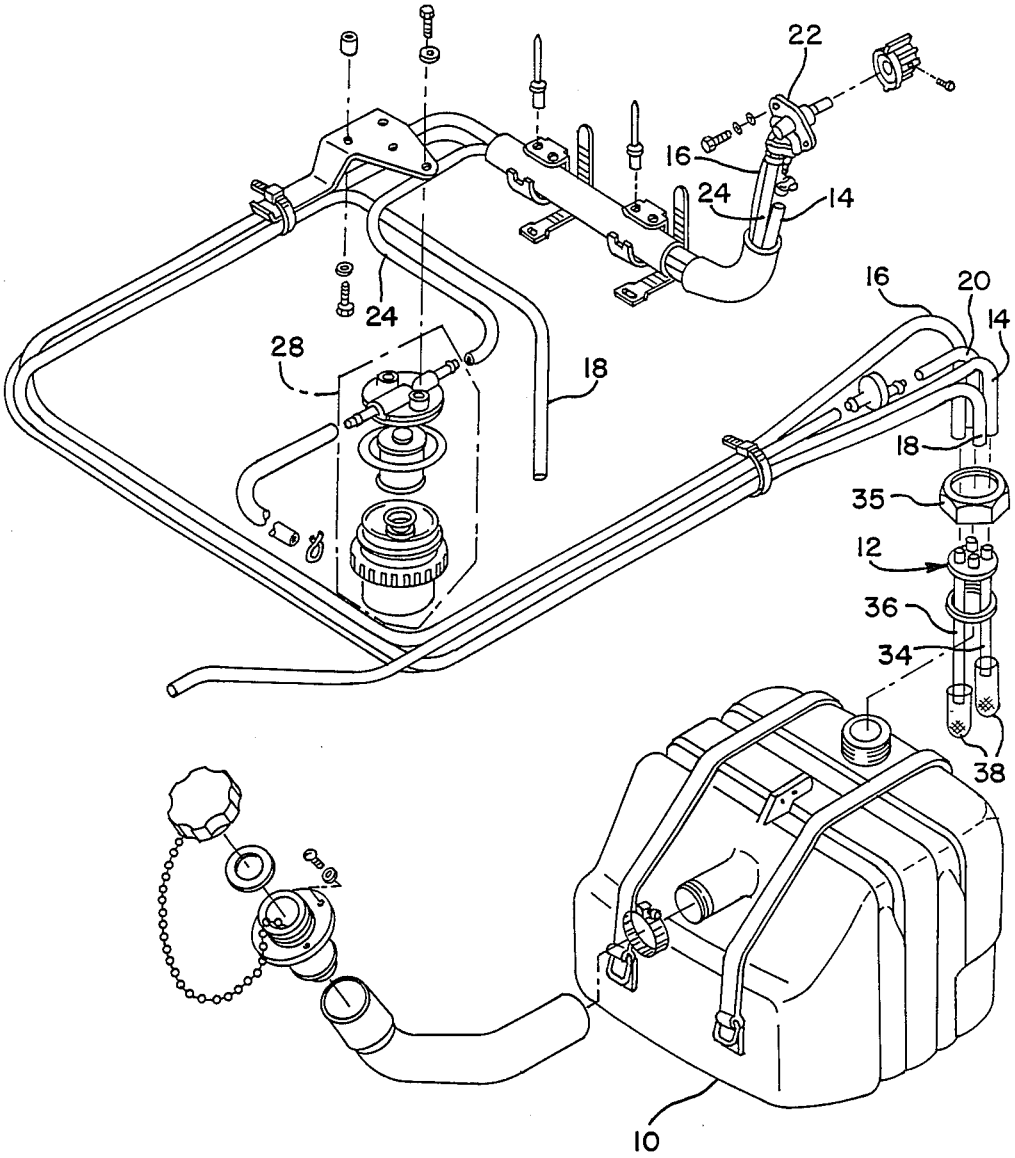
FIG. 1 is an exploded perspective view of a fuel supply system of an engine of a small craft according to the first embodiment of the invention.

With reference to FIG. 1, a fuel system in accordance with the invention for a small craft, includes a fuel tank 10 to which a main fuel tube 14, an auxiliary fuel tube 16, a breather tube 20 and a return tube 18 are connected through a fuel suction unit 12 as explained below in detail.

Figure 2:
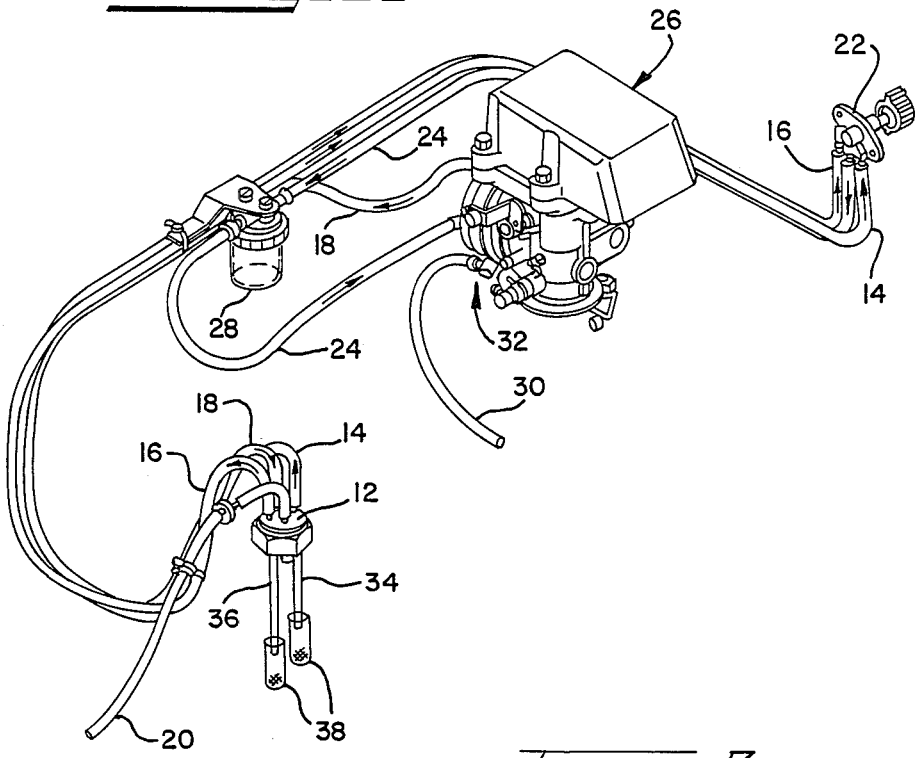
FIG. 2 is another exploded perspective view of the system shown in FIG. 1.

With reference to FIGS. 1 and 2, either of the main and auxiliary tube 14 and 16 is selectively connected by a fuel tap of valve 22 to a fuel supply tube 24, which is connected through a fuel filter 28 to the fuel inlet of an engine carbureter 26 (FIG. 2). The return tube 18 is connected to the fuel drain port of the carbureter 26 and returns excess fuel to the tank 10.

The carbureter 26 is of the floatless type which is unlikely to be influenced when its attitude changes. The carbureter 26 has a fuel pump 32 mounted thereon. The pump 32 is driven by the engine (not shown) by means of a pulse tube 30 so as to cause the pump to suck fuel from the supply tube 24. The foregoing arrangement of the engine, the carbureter, the filter and the pump may be conventional.

The fuel suction unit 12 includes a main suction pipe 34 and an auxiliary suction pipe 36 which is longer than the main pipe 34. The two pipes 34 and 36 are suspended in the tank 10 (see FIG. 3) and held in place by a nut 35 which secures the unit 12 to the tank. The manually operated fuel tap 22 controls the flow of fuel from either the tube 14 or the tube 16 to the tube 24. When the "ON" position of the fuel tap 22 is manually selected during normal use, the fuel is sucked into the shorter or main pipe 34 and the tube 14. When the fuel level in the tank decreases and the "RESERVE" position of the tap 22 is selected, the fuel is sucked into the longer or auxiliary pipe 36 and the tube 16.

Figures 4, 5, 6, 7, 8:
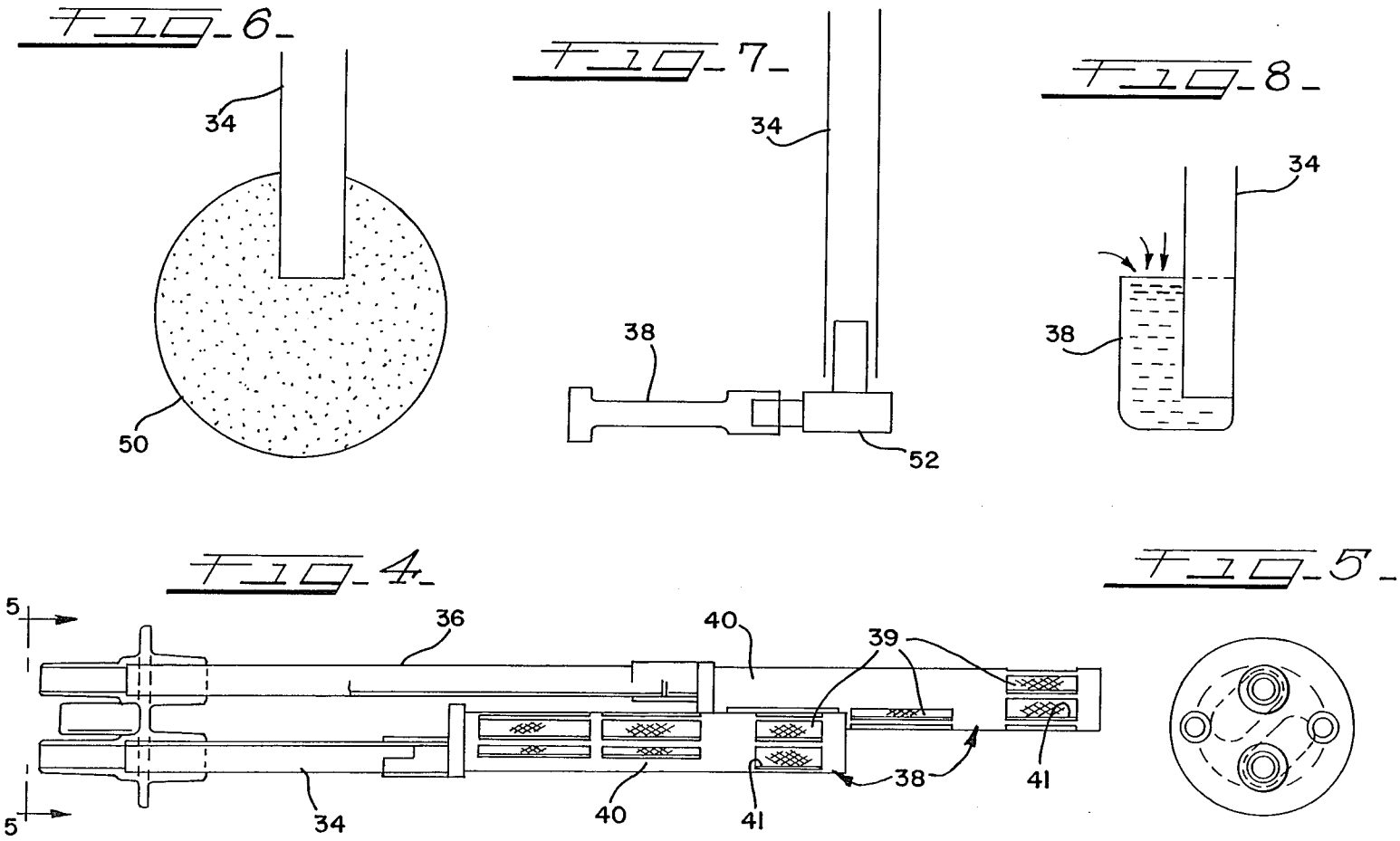
FIG. 4 is an enlarged side view showing parts of the system of FIGS. 1–3.
FIG. 5 is a view taken on the line 5—5 of FIG. 4.
FIG. 6-8 are schematic views showing alternative embodiments of the invention.

As shown in detail in FIG. 4, each of the suction pipes 34 and 36 has a chamber 38 forming a fuel retainer mounted on its lower end. The chamber 38 in this embodiment is formed by a cylindrical container 40 enclosing a fine metal mesh 39 (of the order of 200 mesh, for example). The cylindrical container 40 is formed by a wall which is imperforate except for intake ports 41 in it, and the mesh 39 extends across the ports 41.

Normally the containers 40 are below the fuel level and the chambers 38 are filled with fuel. The mesh or screen 39 functions to retain fuel in the chambers because of the surface tension of the fuel, for one second, for example, or less than the lower ends of the suction pipes 34 and/or 36 come out of the fuel, and the chambers maintain a flow of fuel until the lower end of the pipe 34 or 36 again dips into the fuel.

Figure 3:
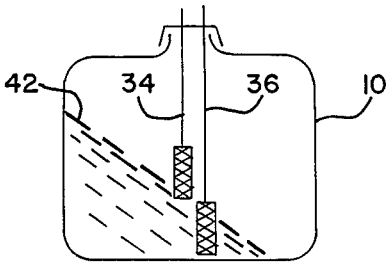
FIG. 3 is a schematic view in vertical cross section of the fuel tank of the system shown in FIG. 1.

In operation, when the craft and the fuel tanks quickly change their attitude and, as shown in FIG. 3, the fuel surface 42 in the tank 10 slopes steeply enough for the lower end of the main suction pipe 34 to move out of the fuel, its chamber 38 retains a small amount of fuel from flowing out of it for a short time. This amount of fuel prevents air from being sucked into the main suction pipe 34. It has been experimentally proven that the amount of air sucked in is greatly reduced when the craft is in actual use. It should be recognized that there is wave action of the fuel within the tank. Consequently even if the craft were to remain at a steep angle for more than a second the fuel waves moving across the containers 40 would replenish the fuel in the chambers and prolong the fuel retention period.

In FIG. 6, a cellular fuel retainer is formed by a sponge or foamed member 50 attached to the end of the pipe 34, the openings of the member 50 forming the fuel retention chamber.

In FIG. 7, a chamber 38 is formed by a container which extends laterally and is connected through a tubular elbow joint 52 to the suction pipe 34. This arrangement saves vertical space.

In FIG. 8, the chamber 38 takes the form of a container or bucket attached to the lower end of the pipe 34.

I claim:

1. A fuel supply system for a small craft including a fuel tank and a pump for pumping fuel from said tank to a carburetor, comprising a suction pipe adapted to be connected to the carburetor and having an inlet opening adapted to be in said tank, said inlet opening of said pipe being at a location which is adjacent the bottom of said tank, and fuel retention means mounted on pipe at said inlet opening for retaining fuel therein when said inlet is above the fuel level in the tank for a short time, said fuel retention means comprising a container mounted around said inlet opening of said pipe, said container being formed by a wall which is imperforate except for flow openings therein at a location where fuel adjacent the bottom of said tank may flow directly from said tank into said container, and means across said flow openings and forming a plurality of small size flow holes.

2. A system as set out in claim 1, wherein said last named means comprises a mesh screen around said inlet opening.

3. A system as set forth in claim 1, wherein said retention means comprises a cellular member around said inlet opening.

4. A system as set forth in claim 1, wherein said container extends laterally of said pipe.

5. A small craft comprising a hull, an engine and a fuel supply tank in said hull, a fuel supply system comprising a fuel pump for pumping fuel from said tank to said engine, a suction pipe connected to said engine and having an inlet opening in said tank, said inlet opening of said pipe being at a location which is adjacent the bottom of said tank, and fuel retention means mounted on pipe at said inlet opening for retaining fuel therein when said inlet is above the fuel level in the tank for a short time, said fuel retention means comprising a container mounted around said inlet opening of said pipe, said container being formed by a wall which is imperforate except for flow openings therein at a location where fuel adjacent the bottom of said tank may flow directly from said tank into said container, and means across said flow openings and forming a plurality of small size flow holes.

6. A system as set out in claim 5, wherein said last named means comprises a mesh screen around said inlet opening.

7. A system as set out in claim 5, wherein said retention means comprises a cellular member around said inlet opening.

8. A system as set out in claim 5, wherein said container extends laterally of said pipe.

* * * * *